United States Patent [19]

Wenger

[11] 4,409,826

[45] Oct. 18, 1983

[54] APPARATUS FOR TEST-FIRING SMALL-ARMS AND HAND-GUNS

[76] Inventor: Fritz Wenger, Neugutstrasse 61, 8600 Dübendorf, Switzerland

[21] Appl. No.: 285,000

[22] Filed: Jul. 20, 1981

[30] Foreign Application Priority Data

Aug. 20, 1980 [CH] Switzerland ..... 6293/80

[51] Int. Cl.[3] ..... G01M 19/00

[52] U.S. Cl. ..... 73/167

[58] Field of Search ..... 73/167; 42/94; 89/37 BA

[56] References Cited

U.S. PATENT DOCUMENTS

| | | | |
|---|---|---|---|
| 2,599,265 | 6/1952 | Leek | 73/167 |
| 4,012,860 | 3/1977 | Auger | 73/167 |
| 4,333,385 | 6/1982 | Culver | 73/167 |

*Primary Examiner*—S. Clement Swisher
*Attorney, Agent, or Firm*—Yount and Tarolli

[57] ABSTRACT

The test-firing apparatus comprises a weapon-holder (WH) accommodating a rifle or hand-gun and a preferably freely mobile mounting (LG), for the said holder, in relation to a stationary base (S). A projecting support means (SA), connected to the weapon, allows the recoil-pulse to be absorbed, in conjunction with the freely mobile mounting, by the body of an operator, as in practical shooting. The only purpose of the mounting, preferably in the form of a linear precision guide comprising cross rollers, is to position the barrel-axis directionally, and the said mounting is therefore subjected to little stress. Resilient and/or damping absorption of the recoil-pulse may also be provided. The barrel-axis (X—X) is arranged in parallel with the movement-axis (Y—Y) of the mounting, so that the point of impact of the bullet upon the target cannot be affected by the recoil-stroke. This parallelism may be adjusted by optical means, preferably by means of a reference-weapon fitted to the weapon-holder, the barrel-axis of the said reference-weapon being fixed parallel with the movement-axis by means of appropriate indexing elements. This indirect alignment is achieved by comparing the shot-patterns of the two weapons.

9 Claims, 4 Drawing Figures

APPARATUS FOR TEST-FIRING SMALL-ARMS AND HAND-GUNS

The invention relates to an apparatus for test-firing small-arms and hand-guns, the said apparatus comprising a weapon-holder adapted to be locked and released and supported upon a base. Apparatuses of this kind are known generally in the form of rigid-rack structures comprising clamping means for the weapon to be tested. They are used to obtain a shot pattern, the main requirement being to remain within a circle of predetermined diameter, in the plane of the target, with a large number of shots.

The conventional rigid clamping of the weapon to be tested permits accurate adjustment of the axis of the barrel and, with a sufficiently stable design, a certain consistency in positional adjustment. On the other hand, unavoidable elastic deformation of the rack-structure, due to the recoil-pulse results, because of the high deformation-rigidity, in comparatively high-frequency oscillations both in the weapon-holder and in the weapon itself, especially in the barrel. This results not only in discomfort during prolonged use, but also in scatter unrelated to the properties of the weapon. Furthermore, although test-firing with rigid clamping of this kind provides a reliable prediction of the performance of the weapon under standard conditions, it does not provide practical information relating to the performance obtained with support and absorption of recoil by the marksman's body.

It is therefore the purpose of the invention to provide a test-firing apparatus for small-arms and hand guns which not only retains the possibility of accurate directional adjustment of the axis of the barrel but is characterized by great consistency in positional adjustment together with recoil-absorption such as occurs in practice, and without high-frequency oscillation of the clamping means and the weapon.

According to the invention, this purpose is achieved, in the case of a test-firing apparatus of the type mentioned at the beginning hereof, in that the weapon-holder is mounted in such a manner as to be mobile, in relation to the base, in the direction of recoil of the weapon under test.

The mobile weapon-mounting used in such a design, known per se from gun-design, accomplishes the same purpose in an outstanding manner, from the point of view of positional adjustment, in that the mobile mounting of the weapon-holder is almost completely relieved of the recoil-pulse acting parallel with the axis of the barrel and from the corresponding forces. Comparatively minor transverse force-components, acting upon the mounting, arise, on the other hand, only indirectly if the guide elements of the mounting are not coaxial with the axis of the barrel and, even then, only if the forces produced by the recoil-pulse act directly upon the base in the vicinity of the mounting. Furthermore, this mobile mounting of the weapon-holder permits resilient damping in the longitudinal support of the weapon against the recoil-pulse, so that no substantial oscillations can occur.

The movement of the mounting for the weapon-holder, in the case of the test-firing apparatus according to the invention, is preferably linear, the axis of the barrel of the weapon to be tested being arranged at least approximately parallel with the axis of this movement. The stroke required to provide resilient damping absorption of the recoil-pulse thus has no detrimental effect upon the shot pattern.

One significant development of the test-firing apparatus according to the invention is characterized in that during at least one portion of the recoil-stroke, the weapon-holder is mounted almost without force, and in that a support means attached to the weapon is provided for the purpose of transferring the force of the recoil to the body of an operator. This not only ensures that absorption of the recoil-pulse occurs under practical conditions, but also eliminates transverse force-components, since the recoil is absorbed by the marksman's body, with no transfer of force to the base in the vicinity of the mobile mounting. Essential, in this connection, is the maintenance of the exact setting of the barrel-axis as a result of guidance of the movement, again preferably by means of a linear mounting.

In the case of weapons having wooden and plastic stocks in particular, there is generally no reference point on the exterior of the weapon for the position and direction of the barrel-axis. In order to provide for rapid and accurate alignment of the barrel-axis in parallel with the path of movement of the mounting, according to a special development of the invention a pick-up is provided, on the weapon-holder, for a reference barrel arranged in parallel with the axis of movement of the mounting, assuming a linear mounting. Positional adjustment of the weapon to be tested may thus be carried out indirectly by comparison with the reference barrel. In principle this may be achieved, for example, by optical determination of sighting points for the two barrels, the adjustments of which are to be compared. Positioning of the weapon to be tested may then be carried out rapidly, by means of a mechanical adjusting device, by comparing the two sighting points.

However, one particularly advantageous development of the invention provides, in this connection, an additional pick-up, on the weapon-holder, for a serviceable weapon, the barrel of which is used as a reference-barrel. Comparison of the positions of the two barrels may now be carried out, particularly simply and rapidly, by a comparison the shot patterns. As a rule, only a few test shots are necessary.

It is desirable to use for this purpose a reference-barrel weapon comprising two retaining surfaces coaxial with the reference-barrel and spaced apart from each other in the direction of the barrel-axis. This not only permits a simple design of pick-up for the reference-barrel weapon but also eliminates, under normal accuracy requirements, separate positional adjustment for the reference-barrel in relation to the axis of movement of the mounting, since the retaining surfaces on the pick-up can easily be previously fixed in the desired parallel position by means of suitable indexing elements. Appropriate cylindrical retaining or bearing surfaces are available, for example, on certain widely used automatic weapons, especially assault guns.

Further characteristics and advantages of the invention are described hereinafter in conjunction with the example of embodiment illustrated in the drawing attached hereto, wherein.

Figure 1:
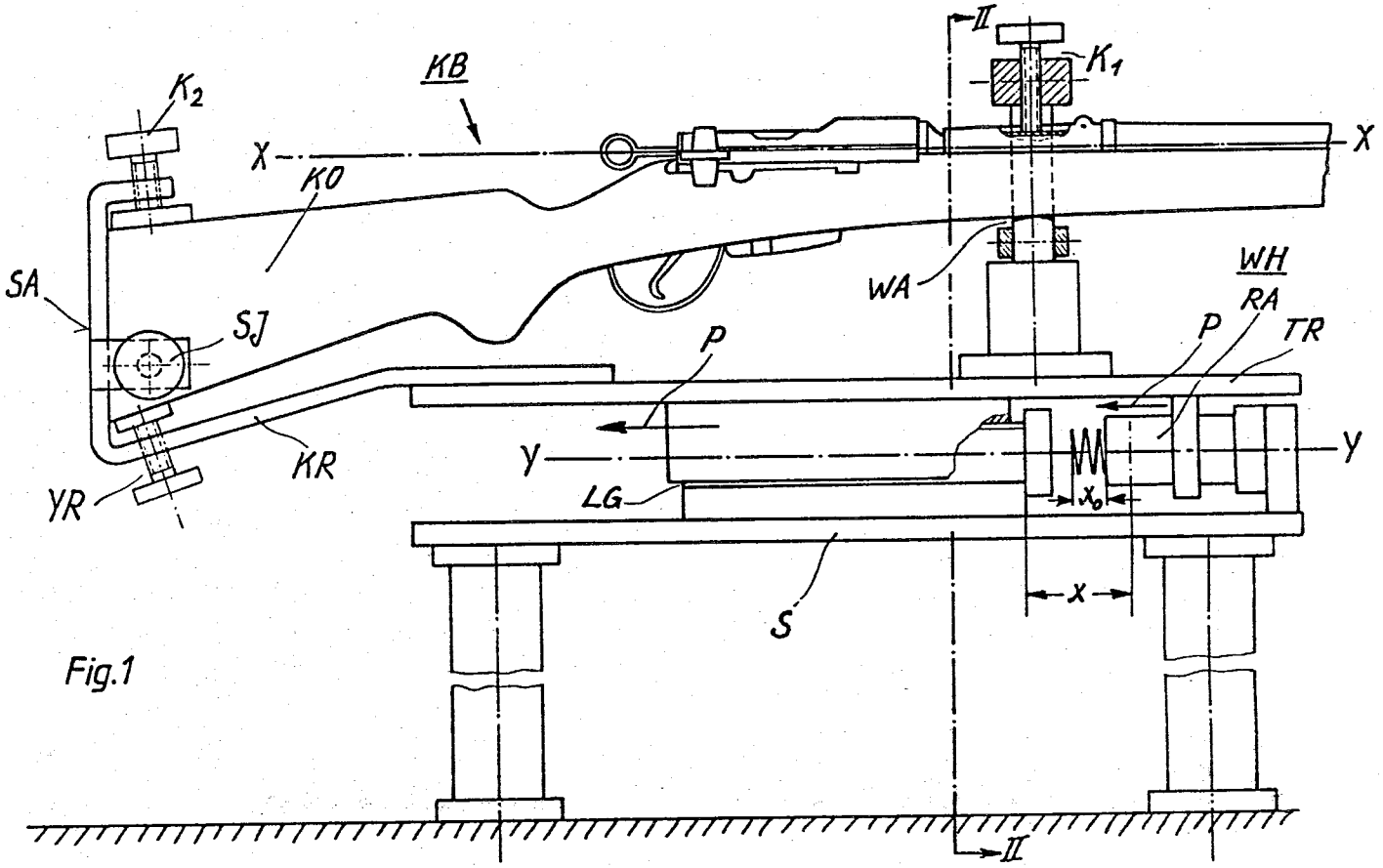
FIG. 1 is a side elevation of a test-firing apparatus with a rifle clamped in position.

According to FIG. 1, the weapon-holder, marked as a whole WH, comprises a horizontal support-plate TR with a cantilever arm KR at the rear end. Secured to the said support-plate is a yoke-like weapon pick-up WA fitted with a clamping element $K_1$ engaging with the rear end of the barrel of a rifle KB to be tested. The rear end of arm KR accommodates the end of rifle-stock KO where it is secured by a second clamping element $K_2$ which forces the stock downwardly onto an adjusting screw YR used for vertical adjustment.

Clamping element $K_2$ is seated upon the rearwardly bent upper end of the vertical member of cantilever arm KR. This vertical member is provided as a support SA through which the marksman's body absorbs the recoil-pulse, thus corresponding substantially to the conditions obtaining when the weapon is in actual use. Also provided is an adjusting screw SJ engaging with the lower part of the end of the rifle-stock and used for horizontal adjustment. The point of engagement of this horizontal-adjustment device is arranged at a distance below the mounting of the rifle-barrel in weapon pick-up WA, thus providing a vertical lever arm for adjustment of the weapon about the horizontal barrel-axis X—X. Although this adjustment, used to compensate for left or right tilt, is not needed for the production of scatter patterns per se, it is desirable for aiming at a target. The said adjustment SJ comprises a counter screw, not shown, on the other side of the stock, so that the said stock may be locked laterally. In the vertical direction, the stock is similarly locked between adjustment screw YR and the screw of clamping element $K_2$.

As shown in FIG. 1, weapon-holder WA is mounted upon a base S by means of a linear mounting LG fitted to the bottom of support-plate PR, and is thus horizontally displaceable in the direction of axis Y—Y. The base is stationary, being anchored by the vertical supports shown. The weapon-holder may thus cary out a recoil-stroke x, in the direction of arrow P, in parallel with movement axis Y—Y of mounting LG. By appropriate rotation of vertical-adjustment screw YR, and of the screw of clamping element $K_2$, barrel-axis X—X may be set parallel with axis Y—Y. As a result of this, horizontal displacement of the weapon during the recoil-stroke cannot affect the point of impact of the bullet on the target. Mounting LG is designed with great accuracy and freedom from play by means of a structural element known per se, for example, a crossed-roller arrangement.

Over a portion of recoil-stroke x, the weapon-holder is mounted almost free of force, so that, at the beginning of this stroke, the recoil-pulse is absorbed entirely by the operator's body, as in actual shooting. This produces very effective damping, corresponding to conditions of actual use and thus avoiding oscillations in the weapon. Thus, the only purpose of the weapon-mounting is to determine direction, and it is therefore subjected to minor mechanical stresses only.

A counter-spring GF is also provided, over a portion $x_o$ of the recoil-stroke, to provide additional resilient absorption of the recoil-pulse. Also provided is a recoil-limiting stop RA which is made of rubber, for example, and acts as a damping element, thus absorbing that part of the pulse not absorbed by the operator. In principle, it is possible to design both the counter-spring and the damping in such a manner as to absorb the total recoil-pulse, thus replacing the absorption by the body of the operator.

Figure 2:
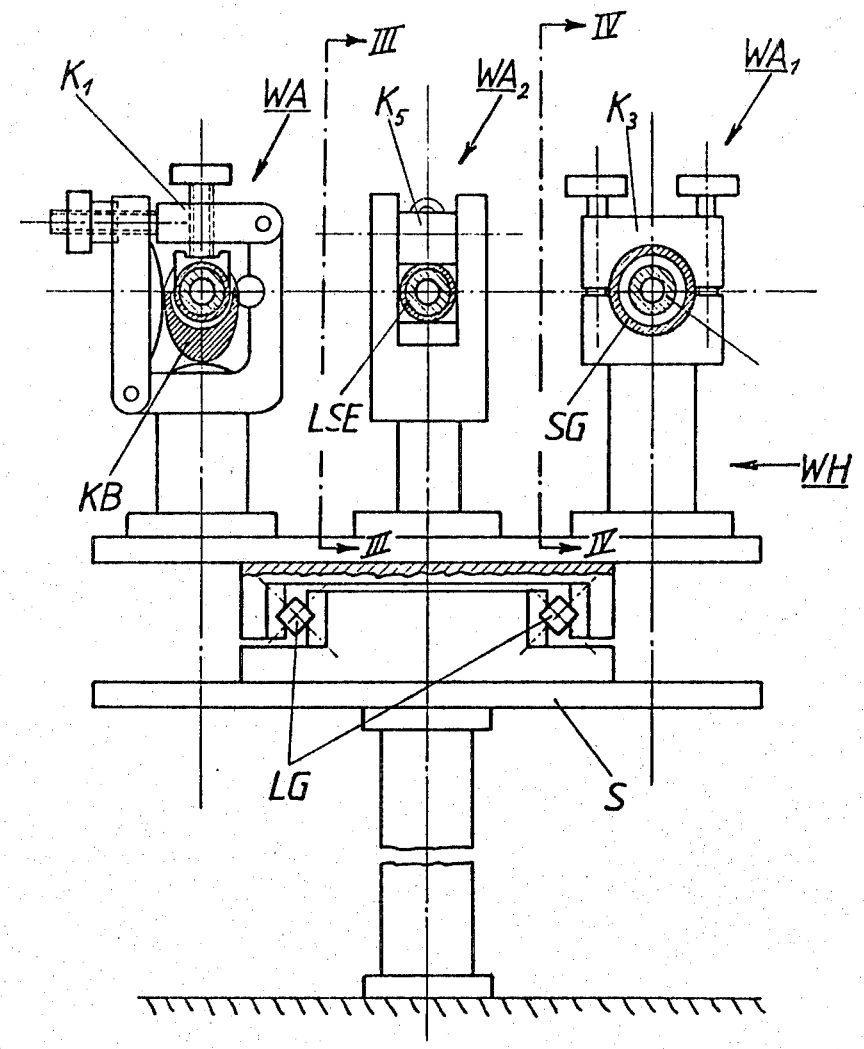
FIG. 2 is a section through the test-firing apparatus along the line II—II in FIG. 1.
Figure 4:
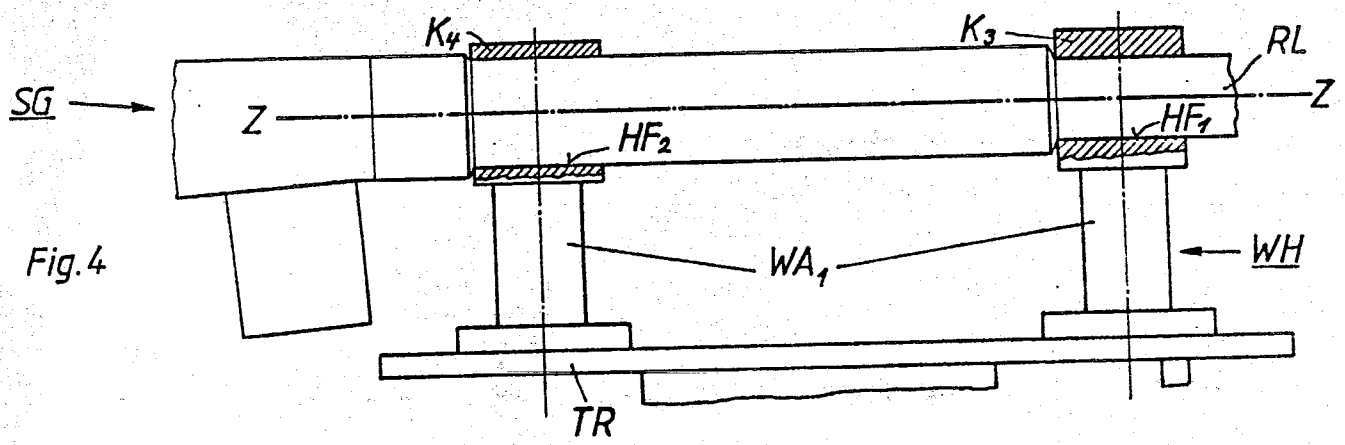
FIG. 4 is a longitudinal section of the test-firing apparatus along the line IV—IV in FIG. 2 with an assault gun clamped in position.

As shown in FIGS. 2 and 4, weapon-holder WH also comprises a pick-up $WA_1$ for an assault-gun SG, the barrel of which serves as a reference-barrel RL for indirect setting-up of barrel-axis X—X of rifle KB. To this end, assault-gun pick-up $WA_1$ is provided with two retaining surfaces $HF_1$ and $HF_2$ coaxial with barrel-axis Z—Z and fitted at a distance from support-plate TR corresponding to an exactly parallel position of axes Z—Z and Y—Y. If necessary, a directional adjustment, not shown, may also be provided, for example in the form of a vertical-adjustment device for one of the said retaining surfaces. Coaxial cylindrical surfaces of the assault-gun barrel, or of an appropriate stock, are held firmly to retaining surfaces $HF_1$ and $HF_2$, by means of clamping elements $K_3$, $K_4$, corresponding to barrel-axis Z—Z.

Here again, the comparatively weak recoil-pulse of the assault-gun, at the free cantilever stock of this weapon, is absorbed by the body of the operator. However, complete or partial absorption may be provided, as indicated hereinbefore, by means of a counter-spring with suitable damping. Obviously the apparatus serves not only for indirect alignment of the rifle, but also for testing the assault-gun itself.

As already indicated in the preamble hereto, indirect alignment is carried out by firing the assault-gun and carrying out, if necessary, an overall directional correction of the test-firing apparatus, in order to adjust the firing pattern on the test target. Subsequent firing of the rifle permits adjustment to be made to obtain approximate coincidence of the shot-patterns of both weapons. It is now possible to assume satisfactory parallelism between the two barrel-axes and thus between barrel-axis X—X and movement axis Y—Y.

Figure 3:
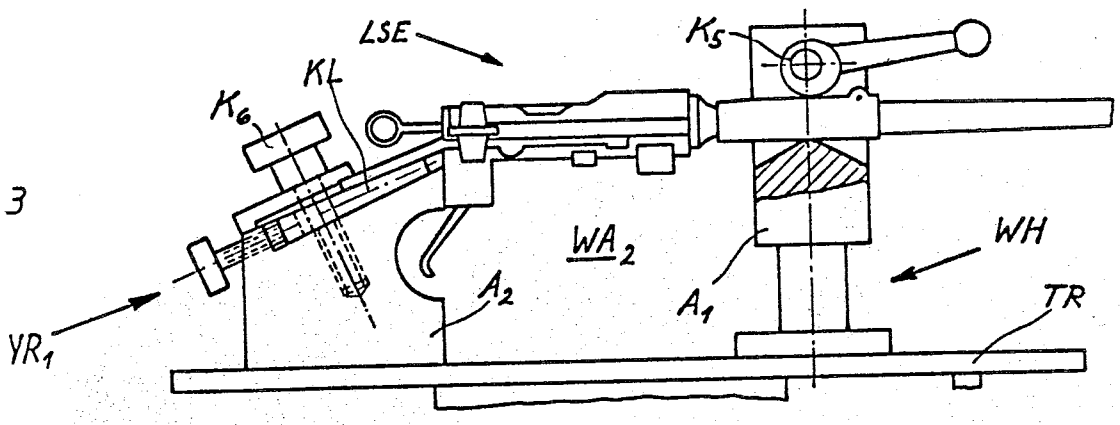
FIG. 3 is a longitudinal section through the test-firing apparatus along the line III—III in FIG. 2 with the barrel-lock unit clamped in position.

If a test of the rifle has produced a corresponding scatter, it is possible by means of an additional weapon pick-up $WA_2$ for serviceable barrel-lock unit LSE of the rifle, to undertake test-firing of the barrel independently of the stock. To this end, weapon pick-up $WA_2$ comprises a front support $A_1$ with a clamping element $K_5$ in the form of an eccentric lever, and a rear support $A_2$ with an adjusting-screw wedge-drive as an alignment adjustment $YR_1$ and a clamping element K6. By moving wedge KL, indicated in FIG. 3, and supporting the rear of the breech, forwards or backwards in a horizontal direction, the rear end of the breech may be raised or lowered, whereupon the rear end of the barrel may carry out a corresponding, minor pivoting motion at front support $A_1$. It is desirable, to this end, to loosen clamping element K5 to some extent. This makes it possible to adjust the barrel-lock unit indirectly, with the aid of the reference-barrel weapon, to a sufficiently accurate position parallel with axis of movement Y—Y. In this way, the shot-pattern will indicate whether the scatter is attributable to the barrel itself or to its retention in the lock.

I claim:

1. Apparatus for test-firing a weapon having a stock and a barrel while allowing at least a part of the recoil force of the weapon to be absorbed by an operator's body, said apparatus comprising a weapon-holder for holding the weapon, said weapon-holder having a part engageable by an operator's body so that the operator's body absorbs the recoil force, base means for supporting said weapon-holder, and mounting means for mounting said weapon-holder on said base means and for allowing sliding displacement of said weapon-holder upon firing of the weapon relative to said base means in a first direction, said mounting means being inoperative to resist said sliding displacement for a first period of time during which the recoil force is absorbed by the operator'body, said mounting means further comprising recoil-absorbing means operative to resist movement of said weapon-holder in the first direction for a second period of time, said apparatus further including alignment means for aligning the barrel of the weapon parallel with the first direction.

2. Apparatus as set forth in claim 1 wherein said weapon-holder comprises clamping means for clamping the weapon into position, and wherein said part engageable by the operator's body comprises cantilever means extending rearwardly along the weapon from said clamping means and adapted to engage the rear end of the stock of the weapon in a manner such that the weapon may be test-fired by an operator while clamped in said clamping means with said cantilever means abutting and disposed between the operator and the rear end of the stock of the weapon.

3. Apparatus as set forth in claim 2 wherein said alignment means comprises first adjustment means for pivoting the weapon about a horizontal axis extending through said clamping means transverse to the longitudinal extent of the barrel, and second adjustment means for pivoting the weapon about the axis of the barrel, said first and second adjustment means being mounted on said cantilever means adjacent the rear end of the stock of the weapon.

4. Apparatus as set forth in one of claims 1 or 3 wherein said recoil absorbing means comprises spring means connected to said mounting means and operative to absorb at least a portion of the recoil force of the weapon during the second period of time.

5. Apparatus as set forth in claim 4 further comprising a rubber damping stop mounted on said mounting means and operative to halt recoil of the weapon during the second period of time.

6. Apparatus as set forth in claim 3 wherein said weapon-holder further comprises means for clamping a reference barrel approximately parallel with the first direction.

7. Apparatus as set forth in claim 6 wherein said reference barrel comprises the barrel of a second weapon to be test-fired for reference which is mounted on said weapon-holder.

8. Apparatus as set forth in one of claims 3 or 7 further comprising means for mounting a stockless weapon having a barrel to be test-fired on said weapon-holder and means for aligning the barrel of said stockless weapon in a vertical plane parallel with the first direction.

9. Apparatus as set forth in one of claims 1 or 3 wherein said part engageable by the operator's body is engageable by the operator's shoulder.

* * * * *